US005295545A

United States Patent [19]

Passamaneck

[11] Patent Number: 5,295,545

[45] Date of Patent: Mar. 22, 1994

[54] METHOD OF FRACTURING WELLS USING PROPELLANTS

[75] Inventor: Richard S. Passamaneck, Littleton, Colo.

[73] Assignee: University of Colorado Foundation Inc., Boulder, Colo.

[21] Appl. No.: 868,627

[22] Filed: Apr. 14, 1992

[51] Int. Cl.[5] ..... E21B 43/263

[52] U.S. Cl. ..... 166/299; 166/308

[58] Field of Search ..... 166/308, 63, 299, 50

[56] References Cited

U.S. PATENT DOCUMENTS

| | | | |
|---|---|---|---|
| 2,766,828 | 10/1956 | Rachford, Jr. | 166/36 |
| 3,001,584 | 9/1961 | Scott | 166/63 |
| 3,002,559 | 10/1961 | Hanes | 166/63 |
| 3,064,733 | 11/1962 | Bourne, Jr. | 166/55 |
| 3,101,115 | 8/1963 | Riordan, Jr. | 166/42 |
| 3,136,361 | 6/1964 | Marx | 166/42 |
| 3,170,517 | 2/1965 | Graham et al. | 166/42 |
| 3,313,234 | 4/1967 | Mohaupt | 102/20 |
| 3,937,283 | 2/1976 | Blauer et al. | 166/307 |
| 4,039,030 | 8/1977 | Godfrey et al. | 166/299 |
| 4,064,935 | 12/1977 | Mohaupt | 166/63 |
| 4,329,925 | 5/1982 | Hane et al. | 102/310 |
| 4,391,337 | 7/1983 | Ford et al. | 175/4.6 |
| 4,446,918 | 5/1984 | Wolcott, Jr. | 166/245 |
| 4,522,260 | 6/1985 | Wolcott, Jr. | 166/245 |
| 4,548,252 | 10/1985 | Stowe et al. | 166/299 |
| 4,633,951 | 1/1987 | Hill et al. | 166/308 |
| 4,673,039 | 6/1987 | Mohaupt | 166/281 |
| 4,683,943 | 8/1987 | Hill et al. | 166/63 |
| 4,711,302 | 12/1987 | Jennings, Jr. | 166/250 |
| 4,718,490 | 1/1988 | Uhri | 166/299 X |
| 4,757,863 | 7/1988 | Challacombe et al. | 166/299 |
| 4,798,244 | 1/1989 | Trost | 166/299 X |
| 4,974,675 | 12/1990 | Austin et al. | 166/250 |
| 5,005,649 | 4/1991 | Smith et al. | 166/308 |
| 5,083,615 | 1/1992 | McLaughlon | 166/308 X |

*Primary Examiner*—Hoang C. Dang

*Attorney, Agent, or Firm*—Dorr, Carson, Sloan & Peterson

[57] ABSTRACT

A propellant is ignited within a well to rapidly produce combustion gases to generate pressure exceeding the fracture extension pressure of the surrounding formation. Combustion gases are generated at a rate greater than can be absorbed into any single fracture, thereby causing propagation of multiple fractures into the surrounding formation. In one embodiment, each segment of the propellant is in the form of a solid cylindrical body of fuel/oxidizer surrounded by an expandable casing made of a material similar to a fire hose. A linear shaped charge extends between the casing and the propellant. Upon ignition of the shaped charge, combustion gases quickly stretch the casing thereby allowing the hot gases to surround and ignite the entire propellant surface area. The propellant then burns in a radially inward direction in a predictable manner. A computer program can be used to model the burn rate of the propellant to predict the resulting generation of combustion gases and fracture propagation, and thereby determine a suitable quantity and configuration of the propellant for creating multiple fractures in the surrounding formation.

13 Claims, 11 Drawing Sheets

FLOW CHART FOR VERTICAL WELL FRACTURING PROGRAM
Sheet 1 of 3

FLOW CHART FOR VERTICAL WELL FRACTURING PROGRAM
Sheet 2 of 3

FLOW CHART FOR VERTICAL WELL FRACTURING PROGRAM
Sheet 3 of 3

FLOW CHART FOR HORIZONTAL WELL FRACTURING PROGRAM

Sheet 1 of 3

FLOW CHART FOR HORIZONTAL WELL FRACTURING PROGRAM
Sheet 2 of 3

FLOW CHART FOR HORIZONTAL WELL FRACTURING PROGRAM

Sheet 3 of 3

METHOD OF FRACTURING WELLS USING PROPELLANTS

BACKGROUND OF THE INVENTION

1. Field of the Invention

The present invention relates generally to the field of fracturing wells. More specifically, the present invention discloses a method and apparatus for creating multiple fractures in wells using propellants.

2. Statement of the Problem

Hydraulic fracturing has been used in the oil industry for many years and has undergone evolutionary changes throughout this period. It has worked effectively in stimulating oil production from wells that were drilled vertically where the borehole passes through hydrocarbon formations having a thickness on the order of tens of feet that can be effectively tapped by a single pattern of fractures extending radially outward from the borehole.

The advent of horizontal well drilling techniques allows a borehole to travel within a hydrocarbon bearing formation for up to thousands of feet. The borehole typically travels through a series of natural fractures that are at some angle with respect to the borehole. When hydraulic fracturing is attempted in such a horizontal borehole, a single fracture pattern usually occurs located along the weakest natural fracture in the formation. This result occurs because hydraulic fluid used in the fracturing process is supplied from the surface and cannot be pumped down the well quickly enough to overload the single fracture that has occurred. If the single fracture is not overloaded, subsequent fractures will not occur since the pressure in the borehole will not rise to the fracture extension pressure of the stronger fractures.

The need to cost-effectively recover oil from tight sand formations presents another challenge. Vertical wells drilled in tight sands are not easily completed using conventional hydraulic fracturing techniques. A significant portion of the fracturing fluid tends to leak off along the well into surrounding formation, rather than serving to fracture the desired hydrocarbon-bearing formation.

A number of devices and processes have been invented in the past relating to fracturing wells, including the following:

| Inventor | U.S. Pat. No. | Issue Date |
|---|---|---|
| Hill, et al. | 4,633,951 | Jan. 6, 1987 |
| Hill, et al. | 4,683,943. | Aug. 4, 1987 |
| Austin, et al. | 4,974,675 | Dec. 4, 1990 |
| Jennings | 4,711,302 | Dec. 8, 1987 |
| Wolcott | 4,522,260 | June 11, 1985 |
| Wolcott | 4,446,918 | May 8, 1984 |
| Ford, et al. | 4,391,337 | July 5, 1983 |
| Hane, et al. | 4,329,925 | May 18, 1982 |
| Godfrey, et al. | 4,039,030 | Aug. 2, 1977 |
| Blauer, et al. | 3,937,283 | Feb. 10, 1976 |
| Mohaupt | 3,313,234 | Apr. 11, 1967 |
| Graham, et al. | 3,170,517 | Feb. 23, 1965 |
| Marx | 3,136,361 | June 9, 1964 |
| Riordan | 3,101,115 | Aug. 20, 1963 |
| Bourne | 3,064,733 | Nov. 20, 1962 |
| Hanes | 3,002,559 | Oct. 3, 1961 |
| Scott | 3,001,584 | Sep. 26, 1961 |
| Rachford | 2,766,828 | Oct. 16, 1956 |

The closest prior art references are believed to be U.S. Pat. Nos. 4,633,951 and 4,683,943 of Hill, et al.

These patents disclose a method and apparatus for fracturing in which the well casing is first filled with a fracturing fluid. A gas generating unit containing shaped charges for perforating the well casing, and a propellant is suspended in the fracturing liquid within the well casing. The fracturing fluid is pressurized from the surface to a predetermined threshold value. The gas generating unit then perforates the well casing and simultaneously ignites the propellant. The propellant forces the fracturing liquid through the perforations and fractures the surrounding formation.

The Rachford patent discloses a system for fracturing in which the well casing is first perforated. A body of propellant is suspended in the fracturing liquid within the well casing and then ignited. The propellant forces the fracturing liquid through the perforations and fractures the surrounding formation.

Mohaupt discloses another system for hydraulic fracturing in which the fracturing liquid is driven by a non-detonating propellant.

Ford, et al., discuss a fracturing apparatus using a high velocity jet to first perforate the well casing. A gas propellant charge carried by the apparatus is ignited to expand the perforation and fracture the surrounding formation. Column 1, lines 25–44 provides a brief synopsis of the prior art relating to propellant fracturing.

Austin, et al., discloses a method of fracturing horizontal wells. A perforating gun carrying explosive charges is used to perforate the well casing. Hydraulic fracturing is then applied.

The Wolcott patents use explosive charges to create rubblized zones connecting horizontal bore holes to increase permeability.

The Scott and Riordan patents discuss the use of propellant to generate a pulse-like pressure boost to supplement the available surface pump pressure in hydraulic fracturing. This is similar in a general sense to the method discussed in U.S. Pat. Nos. 4,633,951 and 4,683,943.

The Bourne patent is another method of hydraulic fracturing in which the well casing is first perforated with shaped explosive charges carried by a perforating gun.

Graham, et al. discloses a method of hydraulic fracturing in which the fracturing liquid is driven by high pressure gas pumped from the surface.

Godfrey, et al., disclose a system in which both a propellant and a high explosive charge are used for fracturing. The propellant is ignited first, followed by detonation of the high explosive. The propellant serves to maintain pressure caused by the high explosive over a longer period.

Hane, et al., disclose an apparatus for fracturing using multiple explosive charges. The remaining references are only of passing interest.

3. Solution to the Problem

None of the prior art references uncovered in the search disclose a method of fracturing using a propellant to rapidly generate a sufficiently large volume of combustion gases, without detonation, to overload the weakest fracture, and thereby create multiple fractures. In a horizontal well, the present method creates a series of plane fractures that are roughly parallel to each other along the length of the bore hole. In contrast, a vertical well will experience a fracture in the least principle stress plane, similar to those produced by conventional hydraulic fracturing, plus a second fracture in a plane perpendicular to the least principle stress plane. The rapid pressurization of the well bore resulting from the burning of the propellant causes the fractures to propagate at rapid extension velocities. These extension velocities are on the order of the sonic velocity of the propellant combustion gases.

SUMMARY OF THE INVENTION

This invention provides a method of creating multiple fractures in the formation surrounding a well in which a propellant is ignited within the well to rapidly produce combustion gases to generate pressure exceeding the fracture extension pressure of the surrounding formation. Combustion gases are generated at a rate greater than can be absorbed into any single fracture, thereby causing propagation of multiple fractures into the surrounding formation. In one embodiment, each segment of the propellant is in the form of a solid cylindrical body of fuel/oxidizer surrounded by an expandable casing made of a material similar to a fire hose. A linear shaped charge extends between the casing and the propellant. Upon ignition of the shaped charge, combustion gases quickly stretch the casing thereby allowing the hot gases to surround and ignite the entire propellant surface area. The propellant then burns in a radially inward direction in a predictable manner. A computer program can be used to model the burn rate of the propellant to predict the resulting generation of combustion gases and fracture propagation, and thereby determine a suitable quantity and configuration of the propellant for creating multiple fractures in the surrounding formation.

A primary object of the present invention is to provide a method for rapidly and cost-effectively creating multiple fractures in a horizontal well.

Another object of the present invention is to provide a propellant canister having a burn rate that can be modeled by computer simulation.

Yet another object of the present invention is to provide a method of modeling the burn rate of the propellant and the resulting fracture propagation in the surrounding formation.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
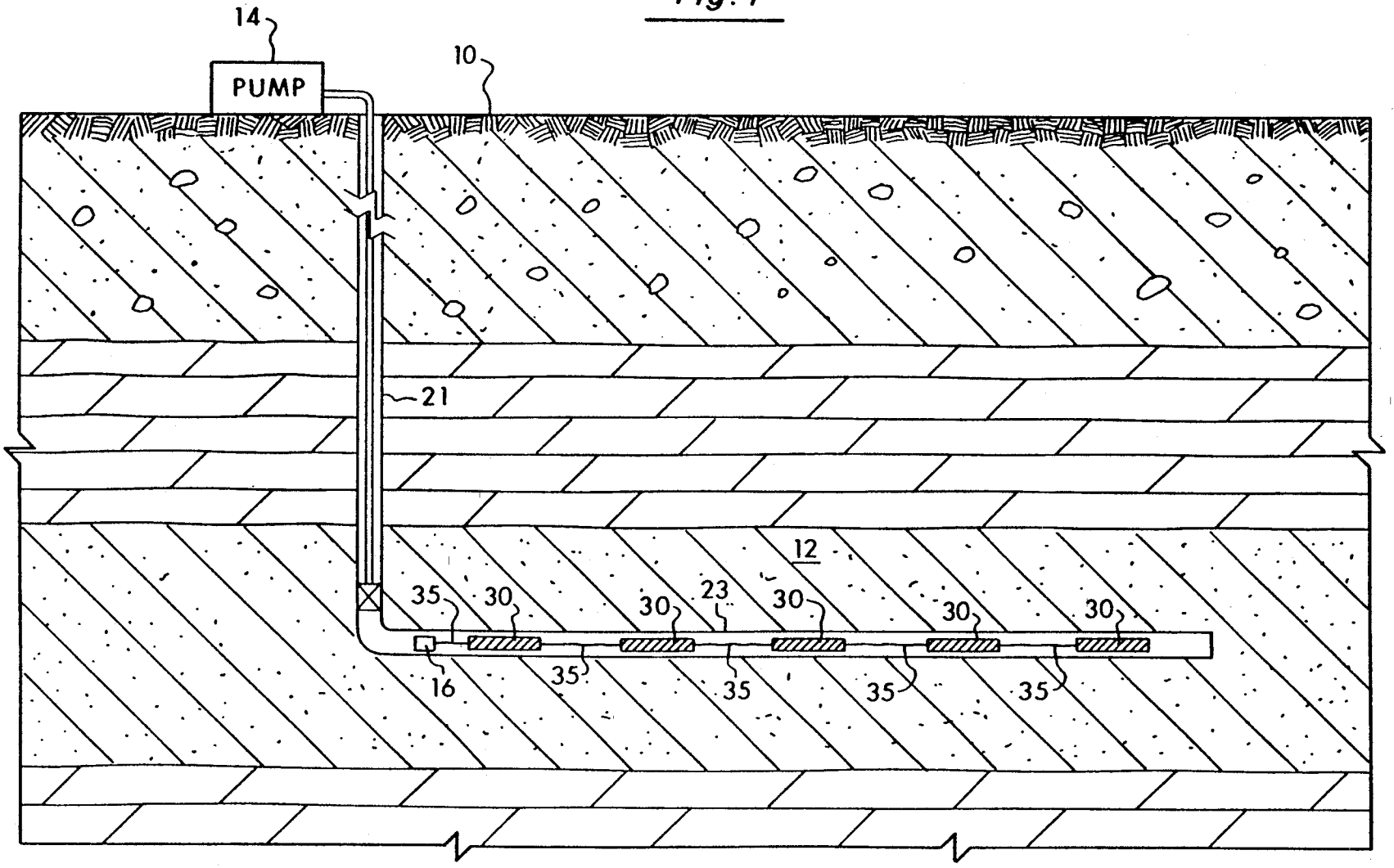
FIG. 1 is a simplified schematic view showing a vertical cross-section of an oil-bearing formation with a number of propellant canisters in place in a horizontal well prior to ignition.

FIG. 1 shows a vertical cross-section of a typical horizontal well common in the oil industry. The well has a vertical leg 21 extending downward from the surface 10 of the earth into the hydrocarbon-bearing formation 12. A horizontal bore hole 23 runs laterally from the bottom of the vertical leg 21 along the plane of hydrocarbon-bearing formation 12.

Figure 2:
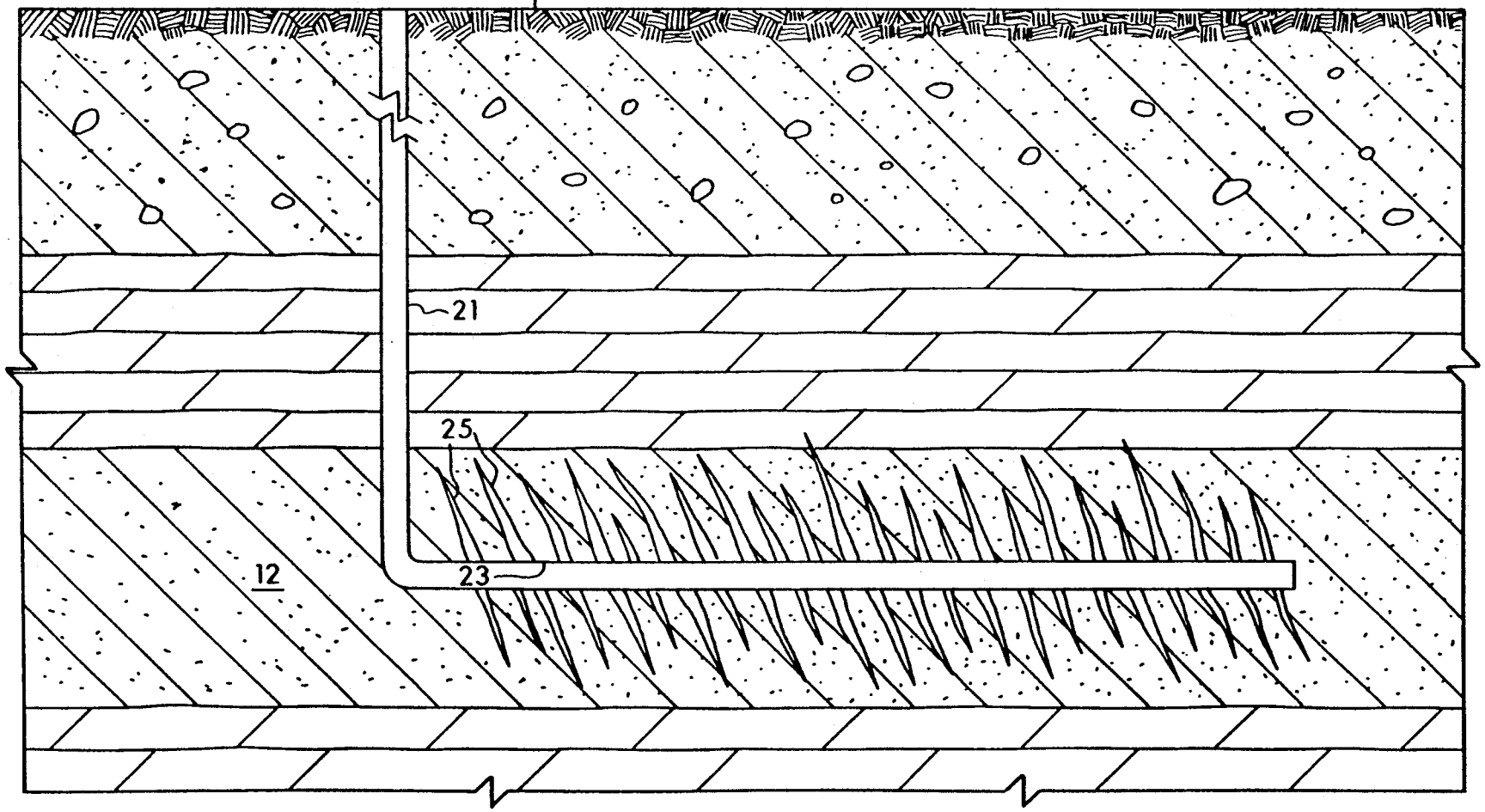
FIG. 2 is a simplified schematic view corresponding to FIG. 1 showing the resulting multiple fractures in the oil-bearing formation after the propellant has been ignited and the fracturing process is completed.
Figure 4:
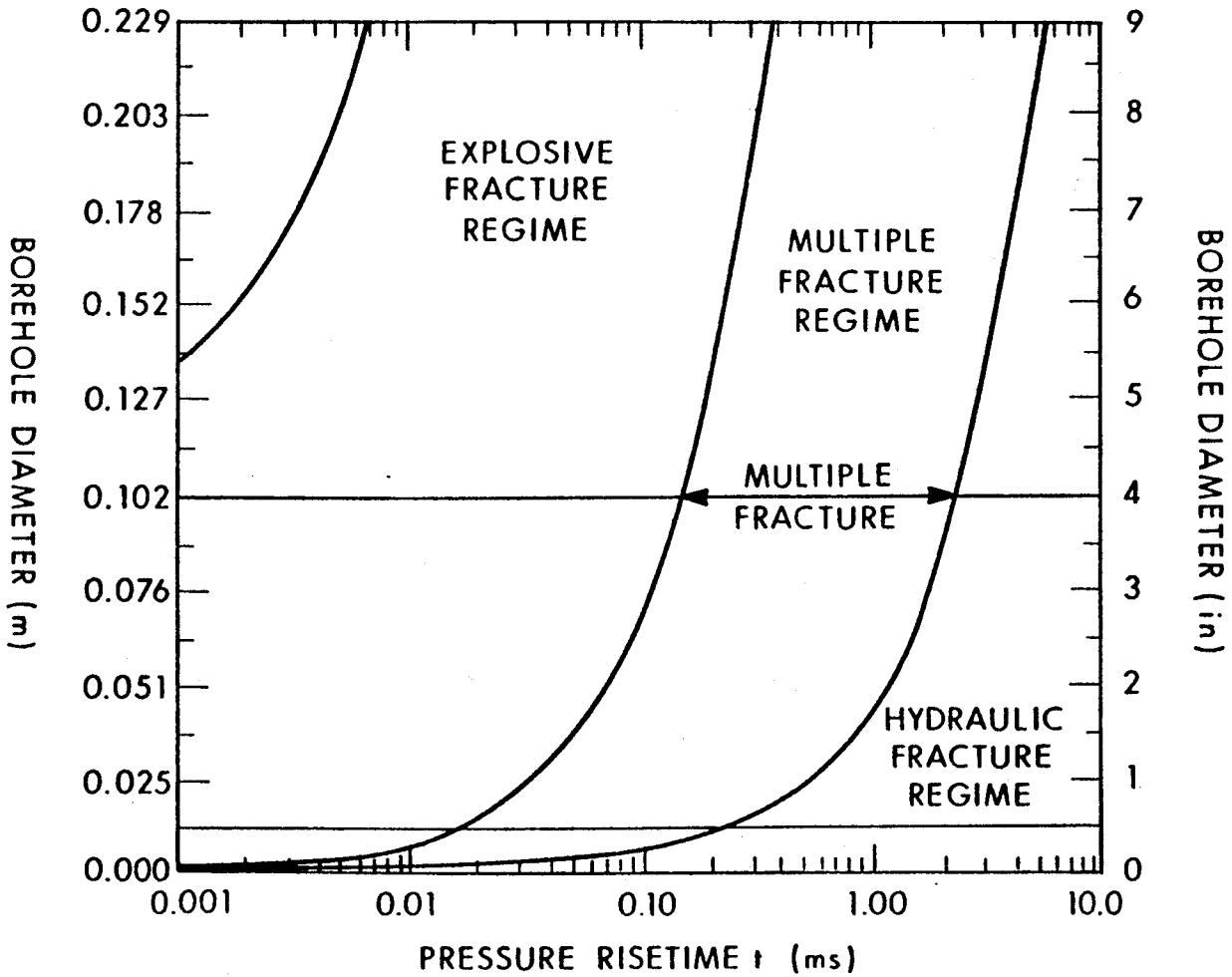
FIG. 4 is a graph of pressure rise time versus borehole diameter. Three different regions are shown corresponding to conventional hydraulic fracturing, multiple fracturing, and explosive fracturing.

It is widely known that propagation of fractures from the bore hole into the surrounding hydrocarbon-bearing formation 12 can greatly increase well production. However, the rise time of the pressure within the well is critical. FIG. 4 is a graph showing the various types of fracturing that occur as a function of pressure rise time and bore hole diameter. Three distinct fracture regimes are seen in this figure. The regime at the far right gives typical hydraulic fractures. Due to the limited rate at which fluid can be delivered from the surface, hydraulic fracturing usually results in propagation of a single fracture structure outward from the borehole into the formation. The regime at the far left gives an explosive fracturing pattern, but is too rubblized to be useful. It should be noted that as one proceeds further to the left, a region of compaction occurs where heat from the reaction actually forms a glass seal. The regime falling between the two curves yields the desired multiple fracture pattern for the present invention. In summary, the goal of the present invention is to rapidly produce combustion gases to generate pressure within said well exceeding the fracture extension pressure of the formation, with the combustion gases being generated at a rate greater than can be absorbed into any single resulting fracture, thereby causing propagation of multiple fractures into the surrounding formation. FIG. 2 is a cross-sectional view corresponding to FIG. 1 after the fracturing process is complete. Multiple fractures 25 extend radially outward from horizontal bore hole 23 into the surrounding hydrocarbon-bearing formation 12.

The appropriate propellant for use in fracturing a bore hole should satisfy a number of important criteria. First, the products of combustion should not be chemically incompatible with the chemistry of the hydrocarbon bearing formation 12, i.e. the combustion products should not cause swelling of the formation or react chemically in a way that would prevent the recovery of raw hydrocarbon products. Second, the propellant should be able to produce combustion gases at a rate that will overload the weaker natural fractures and thus fracture the formation as completely as possible. Third, the total gas volume produced by the propellant burn should be large enough to create a fracture volume that will drain a significant fraction of the oil-bearing reservoir. Fourth, the propellant should not have any radical change in burn rates at critical pressures that might cause the burn to accelerate into detonation. Such explosive fracturing tends to reduce the surrounding formation to rubble and destroys the borehole. Fifth, the propellant should be capable of ignition even if it becomes saturated with water at pressures in excess of 15,000 psi. Finally, in the interest of operator safety, the propellant should be benign at normal atmospheric pressure, even in the presence of an ignition source.

One possible combination found to satisfy the above criteria is a mixture of ammonium perchlorate as the oxidizer and Arcite 386 M as the fuel with a polyvinyl chloride (PVC) binder. The PVC binder was added to provide strength. For example, the binder contributed about 20% by weight in one test embodiment. Arcite 386 M is a proprietary fuel available from Atlantic Research Corporation. Alternatively, a combination of potassium perchlorate, Arcite 497 L, and a PVC binder has also been found to be satisfactory. It should be understood that numerous other oxidizer/fuel combinations are also possible.

Figure 3:
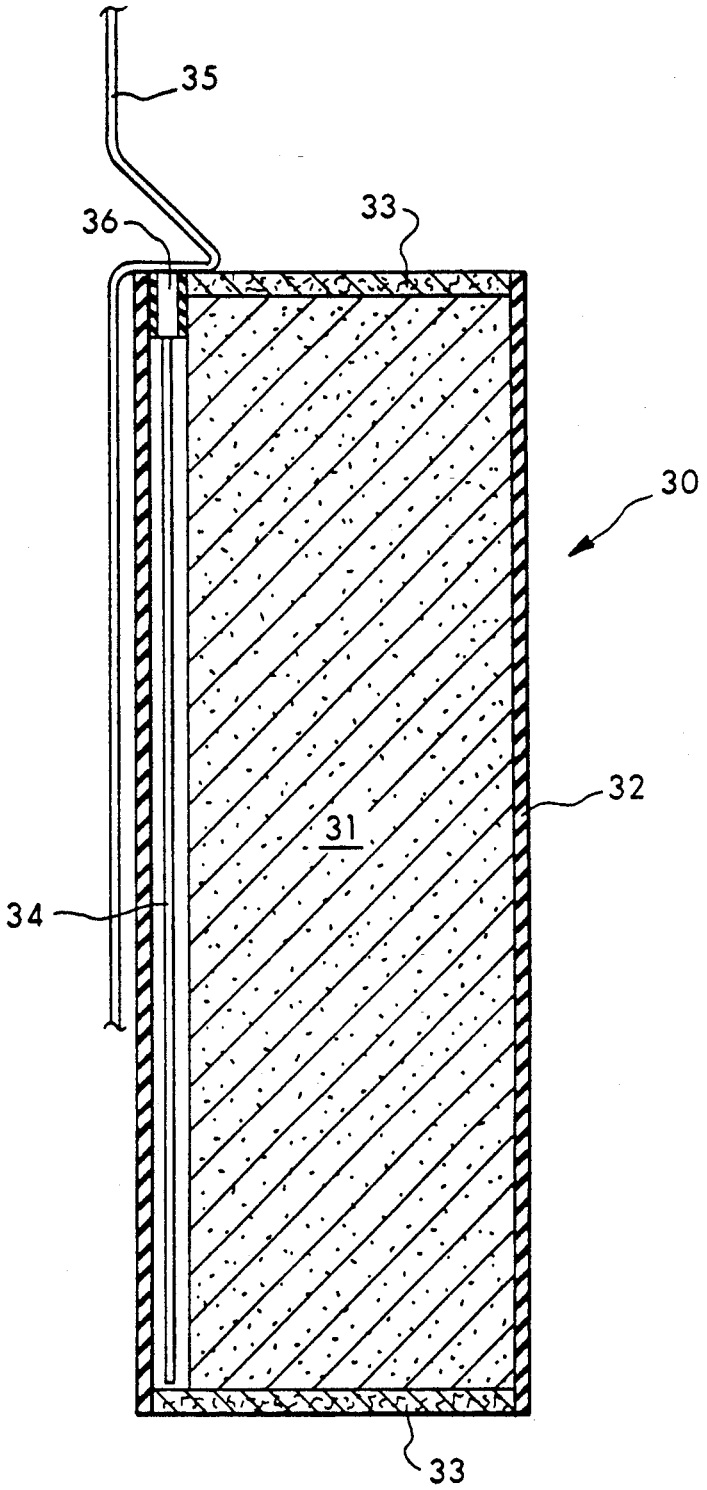
FIG. 3 is a simplified cross-sectional view of one of the propellant canisters.

The means by which the propellant is ignited is crucial to burning the propellant in a consistent and repeatable manner. The combustion surface area should be predictable under any combination of independent variables that determine the burn rate. Without this knowledge, modeling of the process is not deterministic. In the preferred embodiment of the present invention, the propellant is formed into a number of elongated cylindrical segments 31. FIG. 3 provides a cross-sectional view of a typical propellant charge 30. The fuel, oxidizer, and binder have been formed into a generally cylindrical segment 31 having a length of approximately ten feet. A flexible linear shape charge ("FLSC") 34 is placed in a groove running along the cylindrical surface of each propellant segment 31. In addition, a casing 32 made of an expandable material similar to a fire hose (e.g. a rubberized fabric) surrounds the cylindrical surface of each propellant segment 31 and the FLSC 34. The ends of the propellant segment 31 are sealed with water-tight, consumable end caps 33. The FLSC 34 for each propellant canister 30 includes a booster 36 to accelerate ignition. Flexible detonating cord 35 interconnects the boosters 36 for all of the propellant canisters 30, as shown in FIG. 1. A detonator 16 is used to trigger ignition of all of the propellant canisters 30. In the preferred embodiment shown in FIG. 1, a barometric detonator 16 is employed. A bore hole is first drilled. The propellant canisters 30, interconnecting detonating cord 35, and the detonator 16 are then assembled and lowered into position in the well as shown in FIG. 1. A pump 14 pressurizes the well to the trigger point of the barometric detonator 16 which ignites each of the propellant charges 30 to initiate the fracturing process. Upon ignition of the FLSC 34 for each propellant charge 30, combustion gases stretch the expandable casing 32 to allow the hot gases to surround and ignite the entire propellant surface area. The casing 32 either splits or is burned through to permit the escape of combustion gases. The propellant 31 burns in a radially inward direction. The burn is thus predictable and can be modeled.

Figure 5:
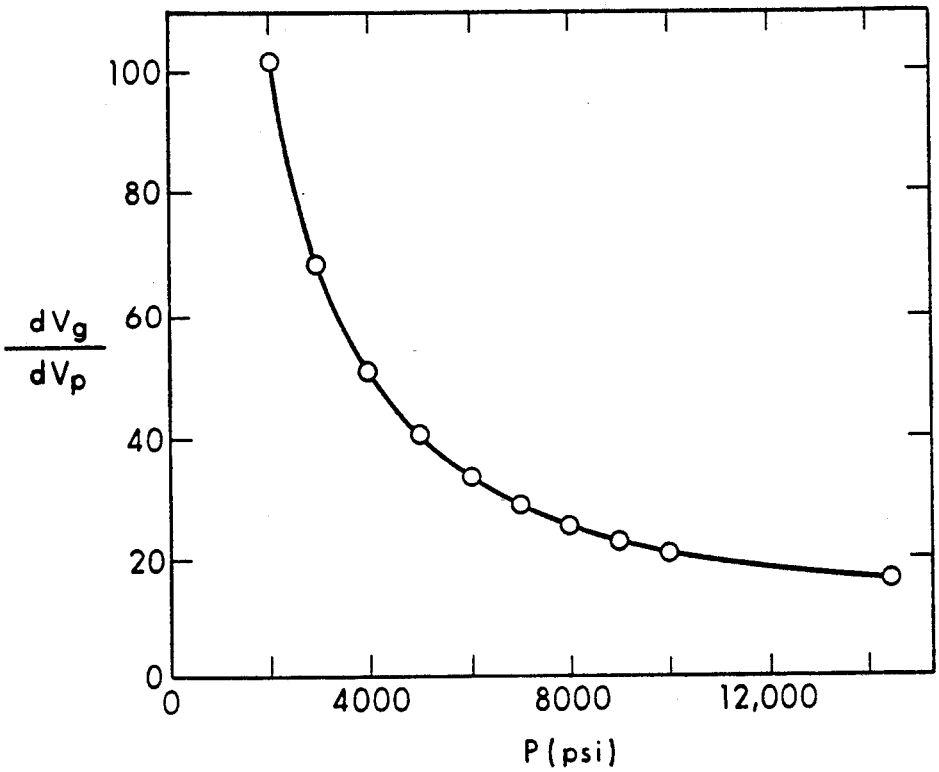
FIG. 5 is a graph showing the volume of combustion gases generated per unit volume of a typical propellant as a function of pressure.
Figure 6:
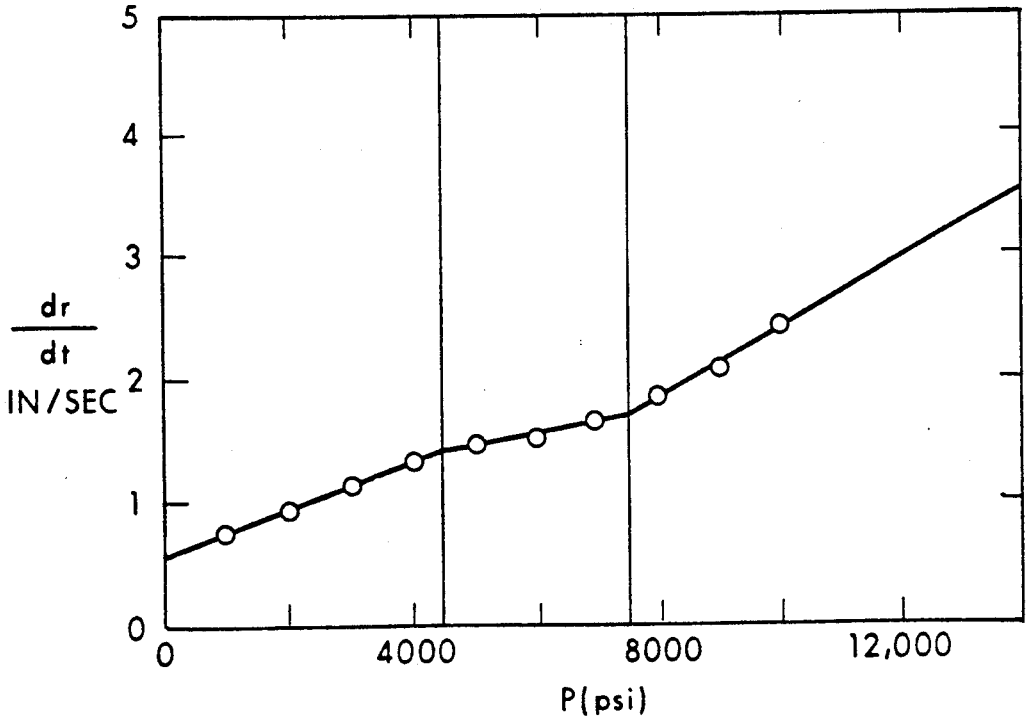
FIG. 6 is a graph showing the burn rate (dr/dt) of a typical propellant as a function of pressure.

Once a combination of fuel and oxidizer have been selected for the propellant mixture, testing is required to obtain gas generation rates and total gas volumes at different conditions for the propellant for the purpose of subsequent computer modeling. For example, testing can be performed at pressures of 1,000 to 10,000 psi in increments of 1,000 psi. This range of pressure testing is unconventional since most propellants operate in standard applications at pressures from 50 to 500 psi. The data obtained from the testing can then be used to develop a mathematical model that predicts the rate of propellant burning and the rate of gas volume generated as a function of pressure and temperature. FIGS. 5 and 6 provide graphs of the test data obtained for a propellant consisting of ammonium perchlorate, Arcite 386 M, and a PVC binder. FIG. 5 shows the volume of combustion gases ($V_g$) produced for each volume of propellant ($V_p$) that is burned, as a function of pressure (P). FIG. 6 shows the radial burn rate (dr/dt) of the propellant as a function of pressure. Similar empirical data can be readily gathered for other propellants.

Figure 10:
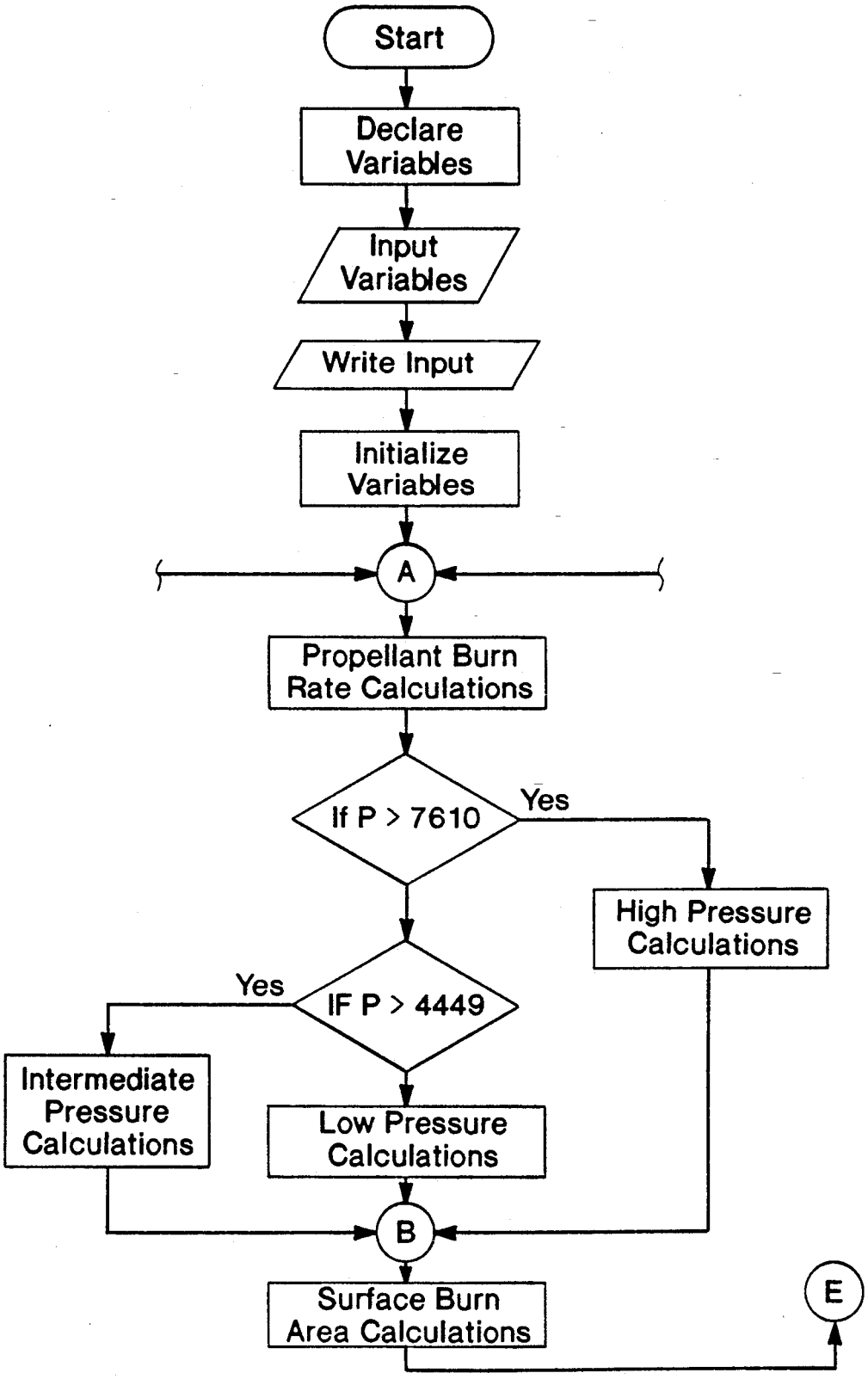
FIGS. 10 through 12 are flow charts of a computer program used to model fracturing in a horizontal well.
Figure 11:
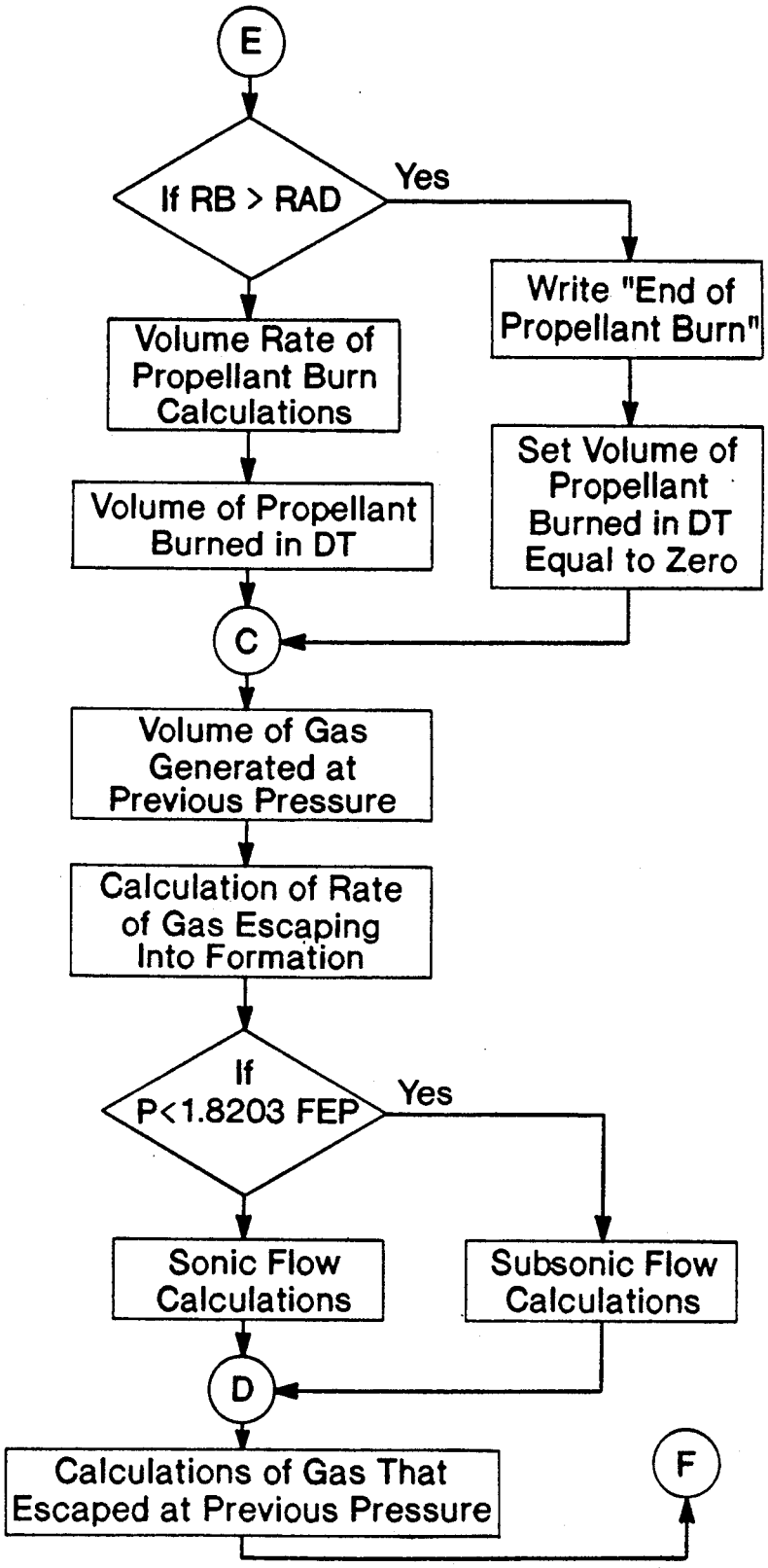
Figure 12:
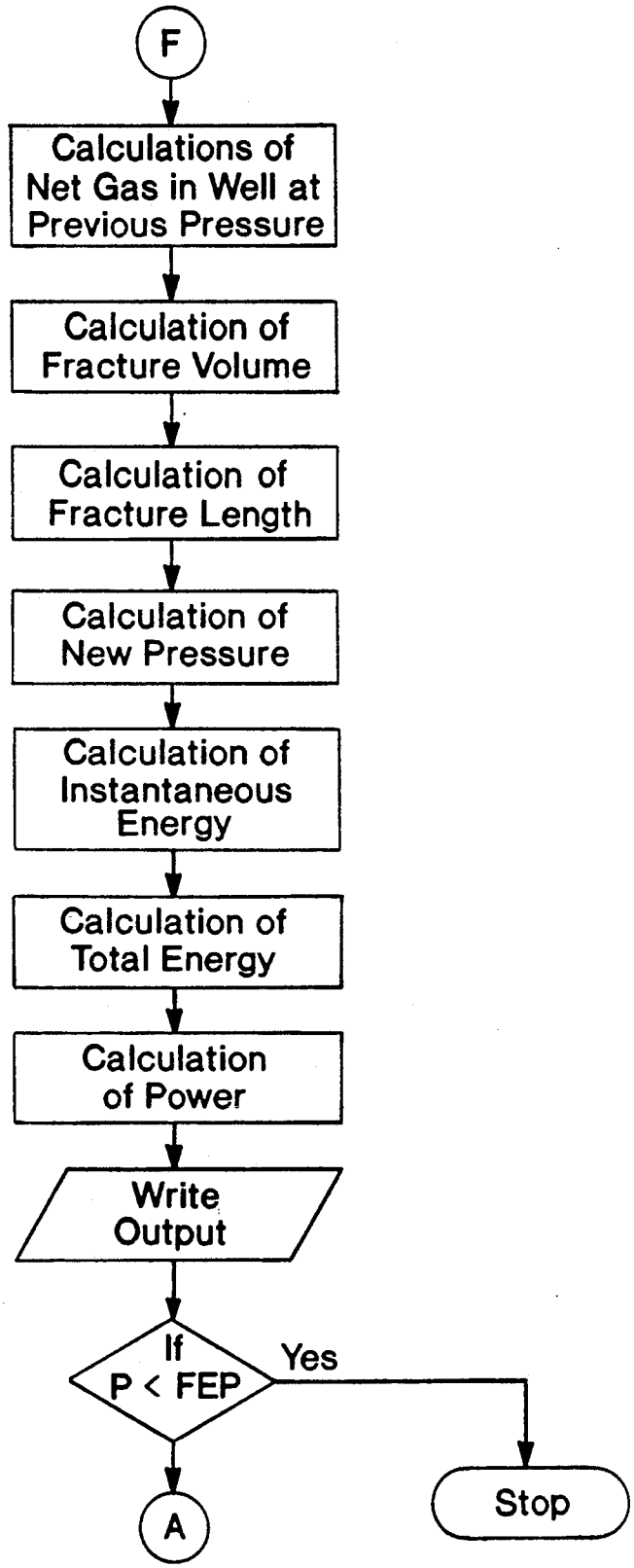

Given this information on the burn rate of the propellant and with empirically derived data concerning the fracture mechanics of the specific formation 12 surrounding the bore hole 23 to be fractured, it is possible to develop a computer program to model the fracturing process at each point in a series of time increments (dt) following ignition of the propellant. FIGS. 10–12 provide a flow chart of a computer simulation of the fracturing process for a horizontal well. After reading input variables for the simulation, the program loops for each time increment beginning at point A.

The burn rate (dr/dt) for the propellant is calculated using empirically derived data for the specific propellant as in FIG. 6. The curve depicted in FIG. 6 has two knees (at 4449 psi and 7610 psi) that define three distinct regimes (i.e. low pressure, intermediate pressure, and high pressure). Moving to point B, the surface area of the propellant being burned is calculated. Moving to point E on FIG. 11, the program checks whether any propellant remains to be burned (RB>RAD). If any propellant remains, the volume of propellant burned during the time increment (dt) is calculated.

Moving to point C, the volume of combustion gases generated is determined according to the graph in FIG. 5. The rate at which combustion gases are escaping into fractures in the formation can then be determined in the steps following point C. First, the pressure in the well is compared to the fracture extension pressure (FEP) and the critical pressure. The critical pressure is found by multiplying the fracture extension pressure by the critical pressure ratio found from standard compressible flow theory for the sonic flow condition. The critical pressure ratio for the combustion gases is approximately 1.8203. If the pressure is less than the fracture extension pressure there is no flow into the formation. If the pressure is greater than the fracture extension pressure but less than the critical pressure, the flow is subsonic. If the pressure is greater than the critical pressure, the flow is sonic. Supersonic flow is not possible because the flow is choked at the fracture entrance. In the case of either sonic or subsonic flow, the resulting flow can be calculated using conventional compressible flow theory. For example, the Mach number (M) of the flow in subsonic conditions can be determined as follows:

$$M = \sqrt{\left[\left(\frac{P}{FEP}\right)^{\frac{\gamma-1}{\gamma}} - 1\right] * \frac{2}{\gamma - 1}}$$

where $\gamma$ is the ratio of specific heat ($c_p/c_v$) for the combustion gases. A typical value for $\gamma$ is approximately 1.28. Alternatively, M=1 in the case of sonic flow. After calculating the Mach number, the velocity (V) of the flow into the fractures can be determined as follows:

$$V = M\sqrt{\gamma RT}$$

where R is the gas constant and T is the temperature of the combustion gases. The volume flow rate (Q) of the combustion gases into the fractures is calculated by multiplying the flow velocity (V) by the cross-sectional area of the fractures by an empirically derived flow coefficient, and then multiplying by the integration time step (dt). The flow coefficient is intended to account for flow constrictions due to rubble, etc. Test data has shown that a flow coefficient of approximately 0.05 to 0.15 provides satisfactory results. The fracture area is estimated by multiplying the height of the fracture (an input variable based on the length of the propellant charge for a horizontal well or the width of the formation for a vertical well) by the width of the fracture. The fracture width is calculated from an empirically derived constant (on the order of 800 to 1200 psi-in.) divided by the fracture extension pressure (FEP).

Moving to point F in FIG. 12, the net quantity of combustion gases in the well is calculated. First, the gas volume generated from the burning of the propellant during each integration time step is multiplied by the current pressure and then divided by the pressure at which it was generated. Second, the results are summed to obtain the total gas volume generated at the current pressure. Third, the new gas generated during the current time step is added to the result from the second step. Finally, the net gas in the well is calculated by subtracting the sum of the gas that has escaped into the formation during all time steps from the total amount of gas generated during all time steps as determined in the third step.

The fracture volume is then calculated. Each fracture volume is calculated by multiplying the sum of all the gas that has escaped into the fracture by the current pressure and then dividing by the fracture extension pressure. The fracture length is calculated in either of two ways. First, if a rectilinear fracture is assumed for a horizontal well, the fracture length is found by dividing the fracture volume by the fracture height and the fracture width. Second, if a dish shaped fracture is assumed for a vertical well, the fracture length is found by dividing the fracture volume by pi and the fracture width and then taking the square root of the result.

The new pressure in the well at the present time increment can then be determined. First, the volume of the well filled with combustion gases is calculated by subtracting the volume of the remaining propellant from the well volume. Second, the change in pressure from the previous time increment is found by dividing the net gas in the well by the gas-filled volume of the well and then multiplying the result by the last calculated pressure. The new pressure is then found by adding the change in pressure to the previous pressure from the preceding time increment.

The total energy is found by summing the products of the fracture extension pressure and the corresponding fracture volume for all the fractures that have been made. The instantaneous energy is found by subtracting the total energy for the preceding time increment from the total energy for the present time increment. The power calculation is found by dividing the instantaneous energy by the time step. The results of the simulation for the present time increment are written to an appropriate output device, such as a printer or the display screen. If the pressure has fallen below the fracture extension pressure, the simulation stops. Otherwise the program loops back to point A and proceeds with the next time increment for the simulation.

Figure 7:
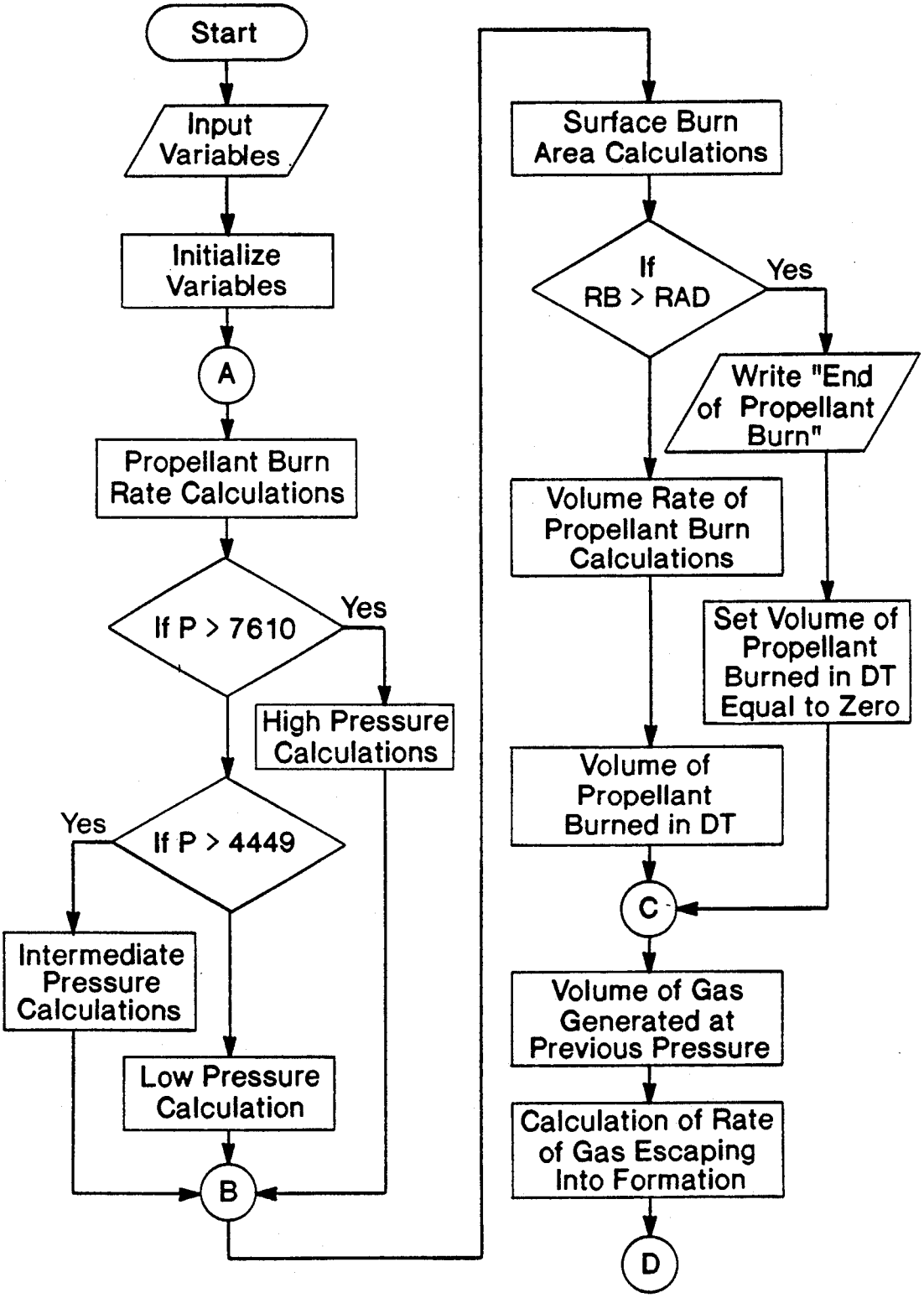
FIGS. 7 through 9 are flow charts of a computer program used to model fracturing in a vertical well.
Figure 8:
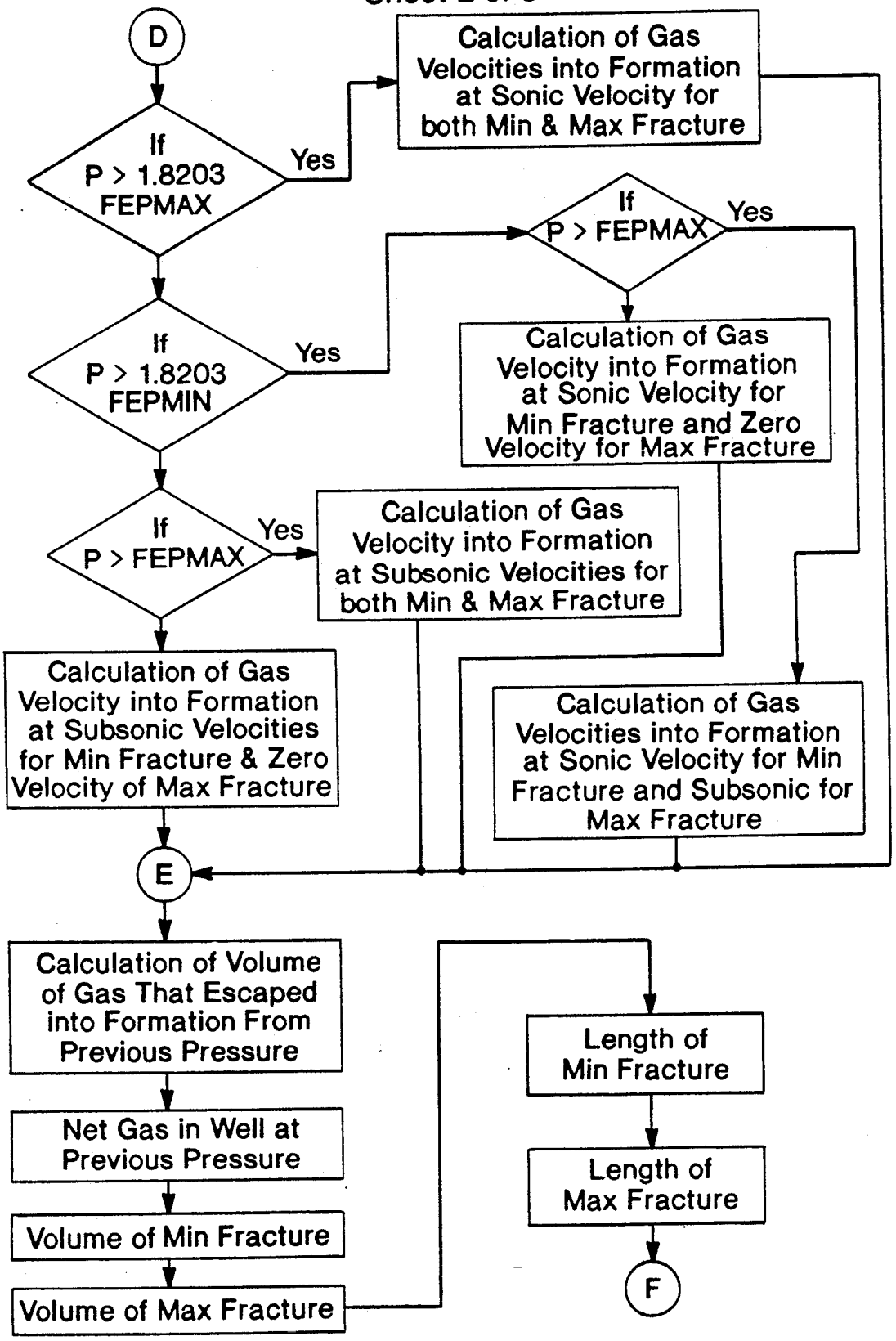
Figure 9:
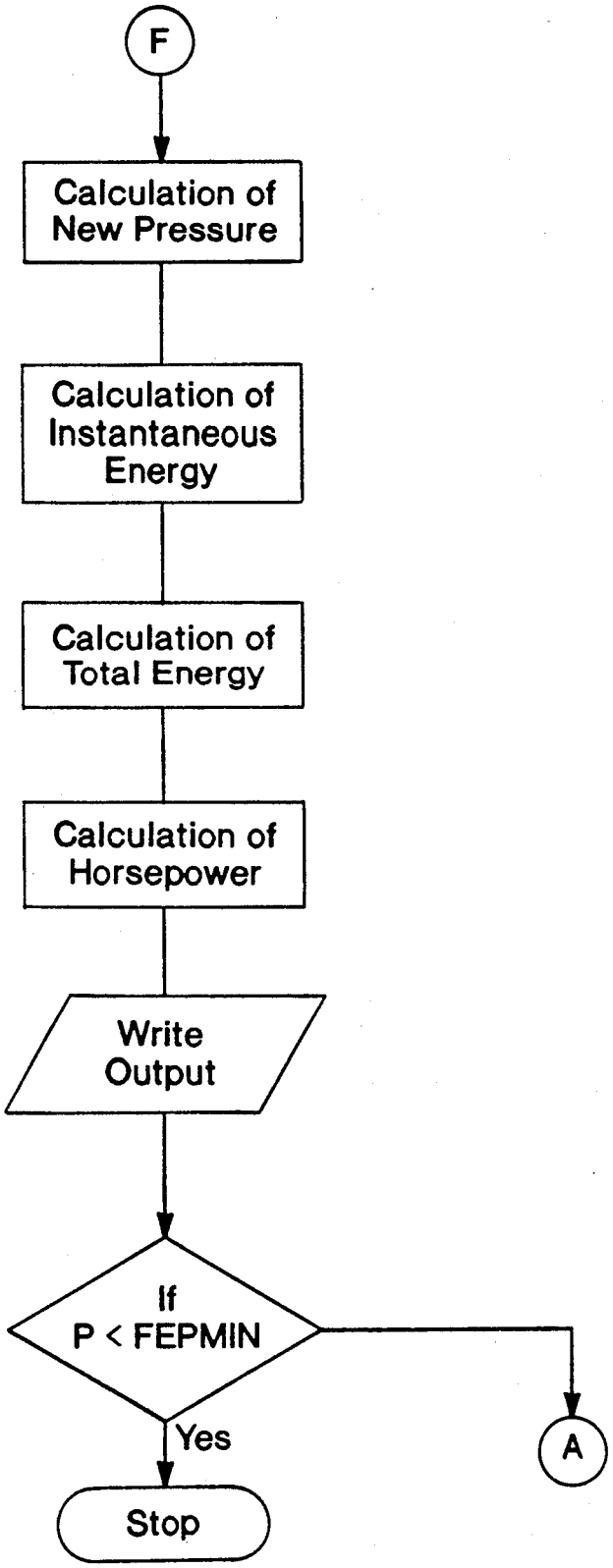

FIGS. 7-9 provide a corresponding flowchart for modeling the fracturing process in a vertical well. The portions of the flowchart shown in FIGS. 7 and 9 are essentially the same as for a horizontal well. However, unlike a horizontal well which tends to produce multiple fractures in a series of parallel planes along the length of the well, a vertical well can produce fractures in at least two perpendicular planes corresponding to the maximum stress plane and the minimum stress plane for the well. Therefore, the simulation must account for the various possible combinations of fracture propagation in both the maximum stress plane and the minimum stress plane. This is shown in FIG. 8. The fracture extension pressure in the maximum stress plane is designated "FEPMAX". The fracture extension pressure in the minimum stress plane is designated "FEPMIN". However, the calculation of the gas velocity (i.e. either sonic or subsonic) into fractures in either plane is essentially the same as before.

The above disclosure sets forth a number of embodiments of the present invention. Other arrangements or embodiments, not precisely set forth, could be practiced under the teachings of the present invention and as set forth in the following claims.

I claim:

1. A method of creating multiple fractures in the formation surrounding at least a portion of the length of a horizontal well, said method comprising the steps of:

selecting a combination of a fuel and an oxidizer for use in a solid propellant having a predetermined outer surface configuration and means to ignite said outer surface;

modeling the burn rate of said outer surface of said propellant within said well to predict the resulting generation of combustion gases and fracture propagation, and thereby determine a suitable amount of said propellant to cause propagation of multiple fractures into said surrounding formation from said well;

introducing said propellant into said well adjacent to the portion of said formation to be fractured; and igniting said outer surface of said propellant to cause the propellant to burn in a radially inward direction to rapidly produce combustion gases to generate pressure within said well exceeding the fracture extension pressure of said formation for a period of time, with said combustion gases being generated at a rate greater than can be absorbed into any single resulting fracture, thereby causing propagation of multiple fractures into said surrounding formation from said well.

2. The method of claim 1, wherein said propellant comprises a solid mixture of a fuel, an oxidizer, and a binder.

3. The method of claim 1, wherein said propellant comprises a combination of Arcite 386 M and ammonium perchlorate.

4. The method of claim 1, wherein said propellant comprises a combination of Arcite 497 L and potassium perchlorate.

5. The method of claim 1, wherein said propellant is fabricated by:

forming a solid body of propellant having an outer surface;

encasing said propellant with an expandable casing covering at least a portion of said propellant surface; and attaching means for igniting said propellant surface within said casing.

6. The method of claim 1, wherein said propellant is fabricated by:

forming a solid mixture of a fuel, an oxidizer, and a binder having an exterior surface;

encasing said solid mixture with an expandable casing covering at least a portion of said exterior surface of said solid mixture;

attaching a shaped charge within said casing adjacent to at least a portion of said exterior surface of said solid mixture; and attaching means for igniting said shaped charge.

7. The method of claim 1, wherein modeling the burn rate of said outer surface of said propellant comprises the following sequence of calculations for each of a series of time increments (dt) after ignition of said outer surface of said propellant;

determining the burn rate of said outer surface of said propellant (dr/dt) and the volume of the resulting combustion gases as a function of the pressure within the well;

determining the flow rate of combustion gases into the fractures;

determining the resulting propagation of fractures; and determining a new estimate of the pressure within the well for said time increment.

8. A method of creating multiple fractures in the formation surrounding at least a portion of the length of a well, said method comprising the steps of:

selecting a combination of a fuel and an oxidizer to serve as a solid propellant having a predetermined outer surface configuration and means to ignite said outer surface;

modeling the burn rate of said outer surface of said propellant within said well to predict the resulting generation of combustion gases and fracture propagation, and determine a suitable quantity and configuration of said propellant capable of generating pressure within said well exceeding the fracture extension pressure of said formation for a period of time, with said combustion gases being generated at a rate greater than can be absorbed into any single resulting fracture, thereby causing propagation of multiple fractures into said surrounding formation from said well;

introducing a body of propellant of said quantity and configuration into said well adjacent to the portion of said formation to be fractured; and igniting said outer surface of said propellant within said well to cause the propellant to burn in a radially inward direction to rapidly produce combustion gases to generate pressure causing propagation of multiple fractures into said surrounding formation from said well.

9. The method of claim 8, wherein said propellant comprises a combination of Arcite 386 M and ammonium perchlorate.

10. The method of claim 8, wherein said propellant comprises a combination of Arcite 497 L and potassium perchlorate.

11. The method of claim 8, wherein said propellant further comprises a polyvinyl chloride vinyl binder.

12. The method of claim 8, wherein said propellant is fabricated by:

forming a solid body of propellant having an outer surface;

encasing said propellant in an expandable casing covering at least a portion of said propellant surface; and attaching means for igniting said propellant surface within said casing.

13. The method of claim 8, wherein said propellant is fabricated by:

forming a solid mixture of a fuel, an oxidizer, and a binder having an exterior surface;

encasing said solid mixture in an expandable casing covering at least a portion of said exterior surface of said solid mixture;

attaching a shaped charge within said casing adjacent to at least a portion of said exterior surface of said solid mixture; and attaching means for igniting said shaped charge.

* * * * *